US005199119A

United States Patent [19]

Weber

[11] Patent Number: 5,199,119

[45] Date of Patent: Apr. 6, 1993

[54] FOOT OPERATED WATER CONTROL

[76] Inventor: Ronald D. Weber, 1 Regulus Ct., Alameda, Calif. 94501

[21] Appl. No.: 723,584

[22] Filed: Jul. 1, 1991

[51] Int. Cl.[5] ..... A47K 1/04; B66D 1/14

[52] U.S. Cl. ..... 4/619; 4/630; 251/295

[58] Field of Search ..... 251/294, 295, 242, 236, 251/320; 4/619, 626, 630; 74/512, 529, 532

[56] References Cited

U.S. PATENT DOCUMENTS

| | | | |
|---|---|---|---|
| 1,212,085 | 1/1917 | Metcalf . | |
| 1,256,525 | 2/1918 | DeDerer . | |
| 1,589,353 | 6/1926 | Bock et al. | 251/294 X |
| 2,187,521 | 1/1940 | Mullett | 4/166 |
| 2,264,876 | 12/1941 | Hackley | 251/295 X |
| 2,293,544 | 8/1942 | Heine et al. | 4/191 |
| 2,542,046 | 2/1951 | Mullett et al. | 4/167 |
| 2,693,716 | 11/1954 | Ludwig | 251/295 X |
| 2,829,537 | 4/1958 | Mall et al. | 74/532 |
| 2,830,618 | 4/1958 | Mitchell | 137/599 |
| 2,965,906 | 12/1960 | Mullett et al. | 4/170 |
| 3,594,828 | 7/1971 | Seek | 251/294 |
| 4,045,827 | 9/1977 | Morris et al. | 4/664 |
| 4,543,850 | 10/1985 | Bednar et al. | 74/512 |

*Primary Examiner*—Charles E. Phillips
*Attorney, Agent, or Firm*—Don J. Flickinger; Jordan M. Meschkow; Lowell W. Gresham

[57] ABSTRACT

A remote control wash basin is disclosed having a foot pedal operation. The foot pedal operates a crank to pull a wire cable that operates a lever to open a normally closed push button valve. Depressing the foot pedal latches the valve into the open position where it remains until a release pedal is depressed. The release pedal occupies the portion of the face of the foot pedal and releases the latch to allow the foot pedal to return to its normally non-operational position. The foot pedal operated fluid controlling mechanism can be added to a wash basin cabinet with minimal changes.

8 Claims, 3 Drawing Sheets

FIG. 1
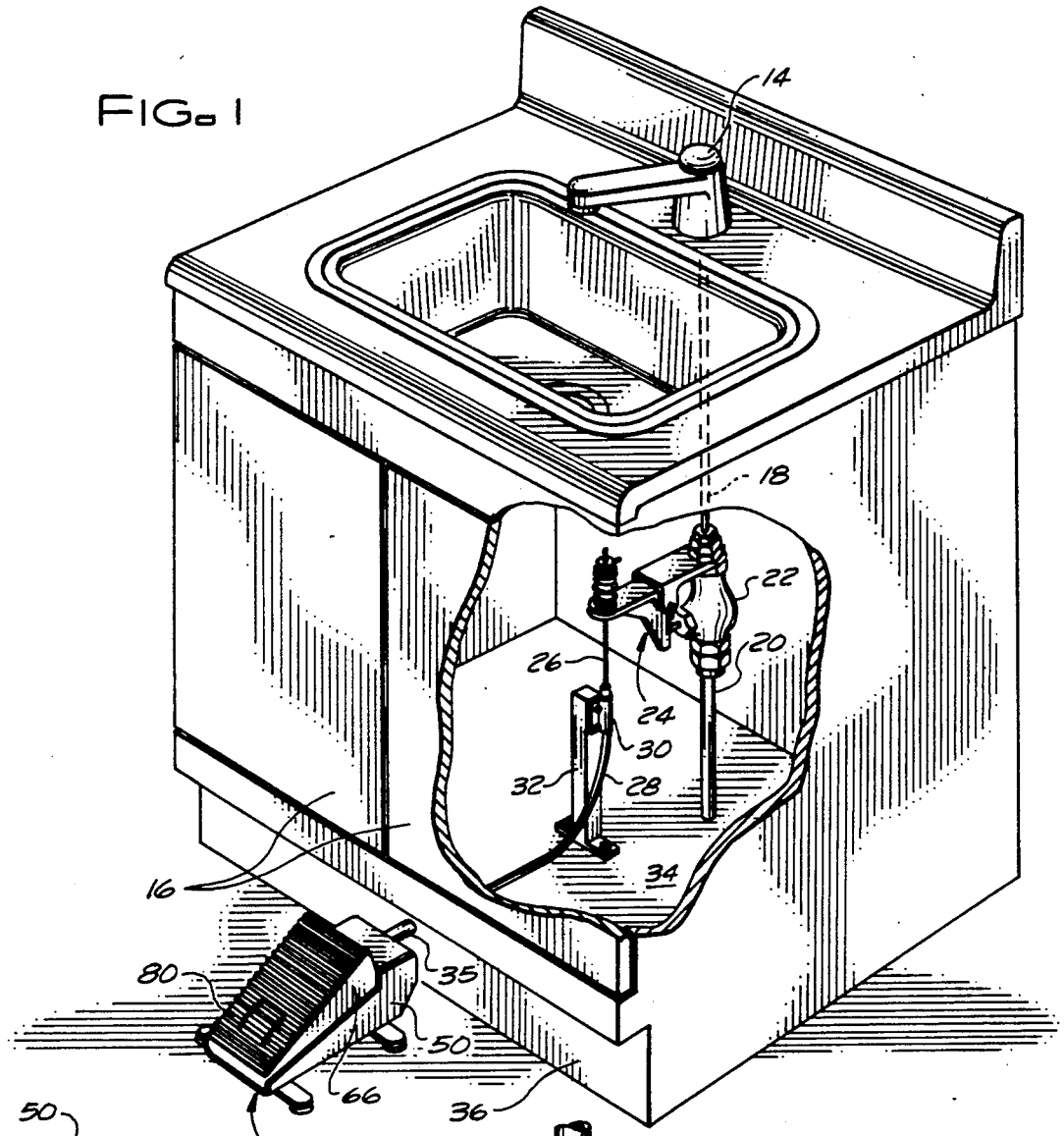
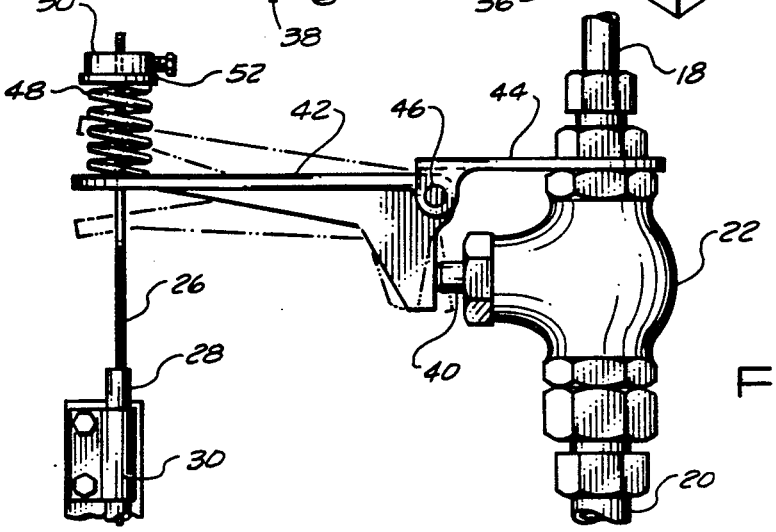
FIG. 2

FIG. 3
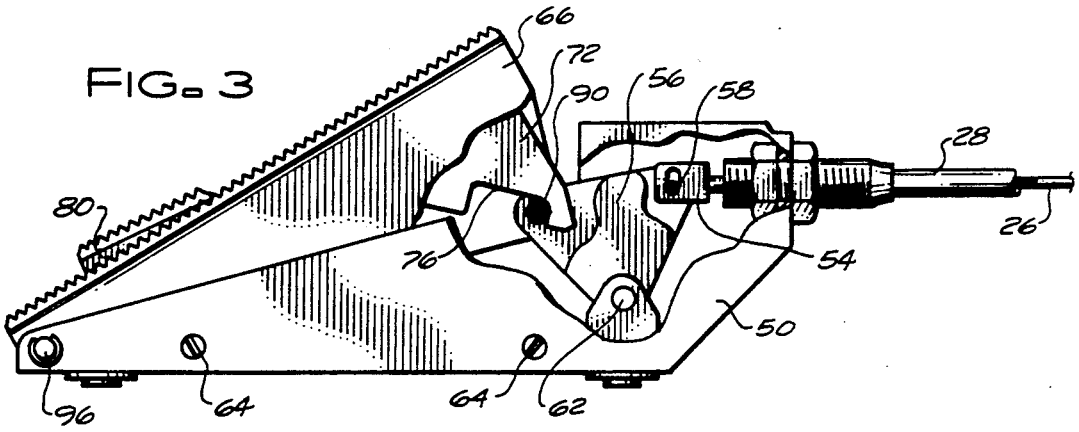
FIG. 4
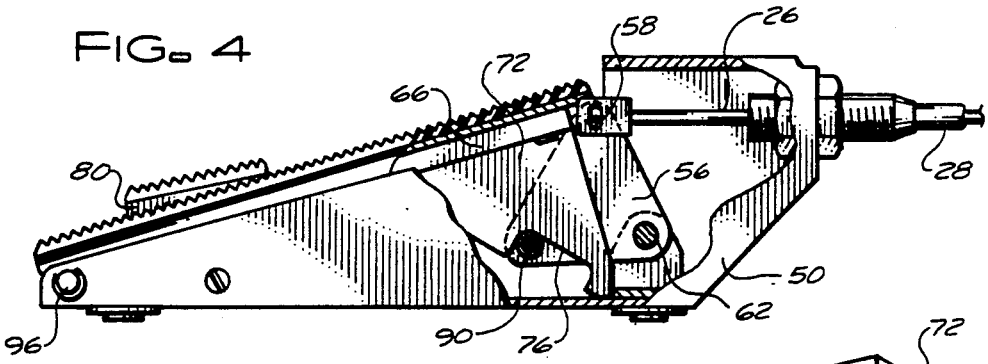
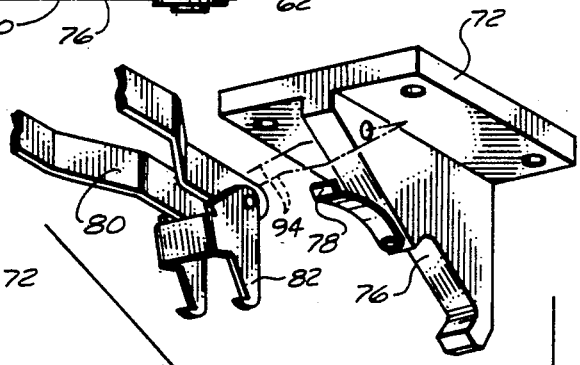
FIG. 7
FIG. 6
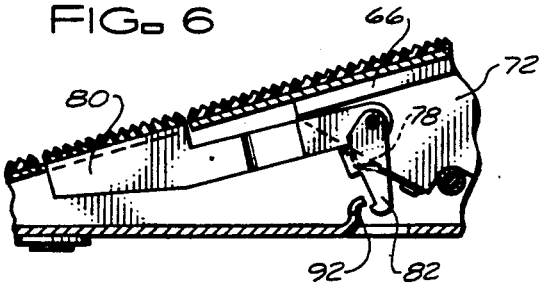
FIG. 5
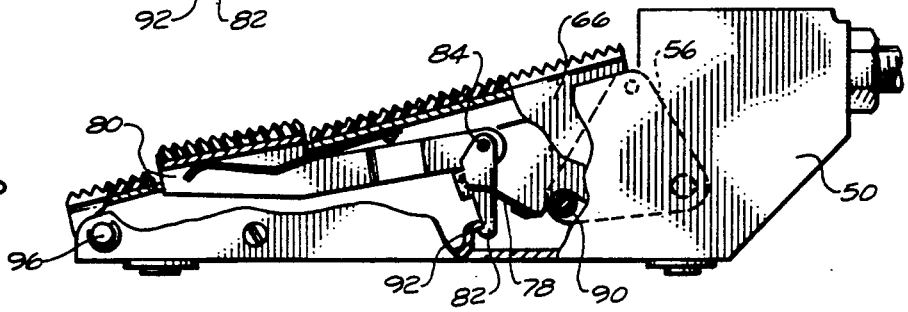

FOOT OPERATED WATER CONTROL

BACKGROUND OF THE INVENTION

1. Field of the Invention

This invention relates in general to water controlling devices and in particular to a faucet operating device having a foot operated valve for controlling the flow of water from faucets.

2. Prior Art

An object of the present invention is to provide a device for use in controlling the flow of fluids, particularly water, the device being particularly adapted for use in controlling the flow of water to a faucet by the use of a foot pedal.

Structures are readily available for the control of water to a wash fountain by a foot operated pedal encircling the wash fountain In the control of individual wash basins the entire wash basin must be specifically designed to accommodate the controls and is built as a particular unit.

Another object of the present invention, therefore, is to provide a foot operated water controlled device that can be easily adapted to wash basins or lavatory cabinets.

Further, the wash basins of the prior art required that the foot pedal be continuously depressed in order to have a water flow from the faucet. The person operating the water flow must continually stand on the foot pedal to control the flow from the faucet This may be fine for workers and non-handicapped people but is non-functional for persons who are handicapped and cannot stand immediately adjacent to the wash basin or who cannot coordinate the depression of the foot pedal while washing themselves at the wash basin.

Therefore, another object of the present invention is to provide a fluid controlling device that can be easily actuated by a foot pedal and latched to continue the flow of the fluid until released.

SUMMARY OF THE INVENTION

This invention contemplates, among other features, the provision of a faucet operating mechanism for wash basins which is operated by the foot so that the operator can wash himself without necessitating the use of his hands in operating the device. According to the present invention, a foot pedal can be depressed to control the operation of a push button valve through a wire cable that operates a lever to actuate the push button valve. The push button valve in turn controls the flow of the fluid into the faucet and the basin The foot pedal includes a latching mechanism that keeps the foot pedal depressed to keep the valve actuated and the fluid flowing. A separate release pedal releases the latch to permit the return of the foot pedal and the closing of the valve to stop the fluid flow.

An object of the present invention, therefore, is to provide a fluid controlling mechanism that can be actuated by the depression of a foot pedal and remains actuated until released.

Yet another object of the present invention is to provide a foot operated fluid controlling device that can be easily adapted to presently installed wash basins to permit the continued flow of water from a faucet when the foot pedal is depressed and stops the flow of water when a release pedal is depressed.

The foregoing and other objects, features and advantages of the invention will be apparent from the following more particular description of the preferred embodiments of the invention, as illustrated in the accompanying drawings.

BRIEF DESCRIPTION OF THE DRAWINGS

The various novel features of this invention, along with the foregoing and other objects, as well as the invention itself both as to its organization and method of operation may be more fully understood from the following description of illustrated embodiments when read in conjunction with the accompanying drawing, wherein:

FIG. 1 is a perspective view of the present invention as adapted to a wash basin with a cut away view to show the internal connections;

FIG. 2 is a side view of the valve operation shown in the cut out section of FIG. 1;

FIG. 3 is a cut away side view of the foot pedal of FIG. 1 showing the pedal in the non-operating position;

FIG. 4 is a cut away view of the foot pedal of FIG. 1 showing the foot pedal in the latched position;

FIG. 5 is a cut away view of the foot pedal of FIG. 1 showing the operation of the latch mechanism in the latched position of FIG. 4;

FIG. 6 is a cut away view of the foot pedal of FIG. 1 showing the operation of a release pedal to release the latching mechanism;

FIG. 7 shows a partial perspective view of the latching mechanism interacting with the cable actuating mechanism.

DETAILED DESCRIPTION OF THE PREFERRED EMBODIMENT

Figure 8:
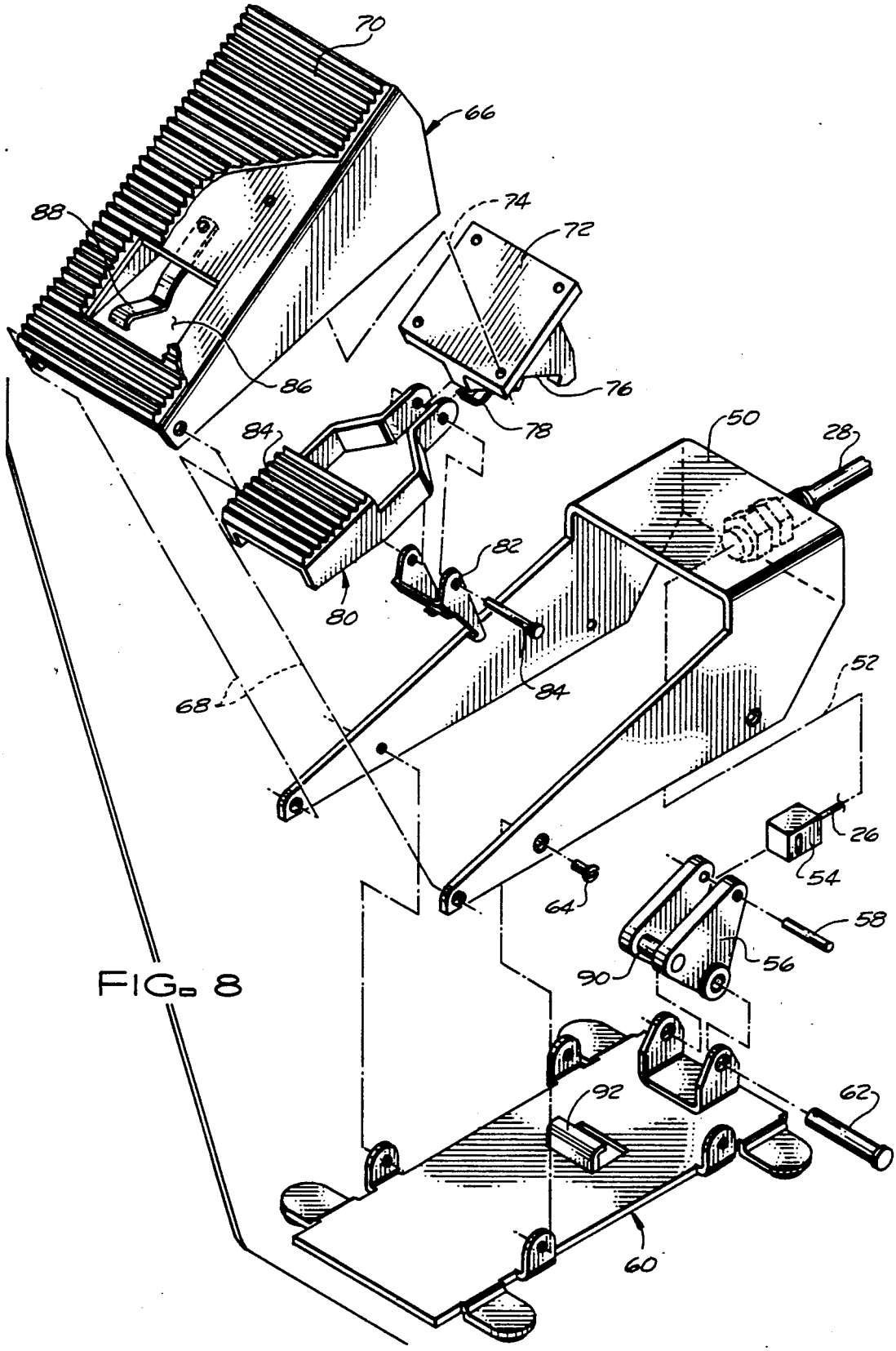
FIG. 8 shows an exploded view of the interaction of the parts in the foot pedal of FIG. 1.

In general, the fluid controlling mechanism of the present invention can be used with any type of wash basin such as the lavatory cabinet shown in FIG. 1. The mechanism can be used to control either a single supply of water, either hot or cold, or a dual supply mixing valve which can supply a combination of hot and water.

Referring now to FIG. 1, a wash basin shown as a lavatory cabinet 10 includes a sink 12 and at least one faucet 14. The lavatory cabinet 10 generally includes doors 16 which can be opened for access to the area internal to the lavatory cabinet 10. In FIG. 1, the lavatory cabinet 10 includes a cut away portion to show the interconnections of the mechanism of the present invention. Further water supply pipes and sewer interconnections to the sink 12 are not shown in order to simplify the Figure while continuing to show applicant's unique structure.

Leading from the faucet 14 is a water connecting pipe 18 and an inlet water pipe 20 suppling the water fluid to a push button valve 22. The push button valve 22 operates to control the water flow from the inlet water pipe 20 to the connecting water pipe 18 for discharge of the water through the faucet 14. A lever mechanism 24, shown in more detail in FIG. 2, operates the push button valve 22 via a wire cable 26 passing through a guide 28 that is clamped by a clamp 30 to a standard 32 mounted to a base 34 of the lavatory cabinet 10. The wire cable 26 and the guide 28 exit through an opening 35 in a panel 36 located at the base of the lavatory cabinet 10. The wire cable 26 and guide 28 connect to a foot pedal assembly 38. A more complete operation of the push button valve 22 of FIG. 1 as interconnected to wire cable 26 is shown in FIG. 2.

Referring now to FIG. 2, the push button valve 22 has its plunger 40 operated by a lever 42 pivotally connected to a support arm 44 through a lever pin 46 which all form a part of the lever mechanism 24, see FIG. 1. The free end of the cantilevered lever 42 is operated by the wire cable 26 through a lever spring 48. The lever spring 48 actuates the lever 42 by the operation of the wire cable 26. The lever spring 48 is held in place by a retainer 50 and a washer 52. As shown also in FIG. 1, the wire cable 26 passes into the guide 28 for connection to the foot pedal 38. The guide 28 is held in place in the lavatory cabinet 10 by virtue of the clamp 30. The connection of the wire cable 26 and the guide 28 to the foot pedal 38 is shown in the exploded view of FIG. 8.

The prior art is replete with various valve structures having a valve stem in the form of a plunger which is biased into a normally closed position. Lever mechanism 24 was especially devised for adapting a push button type plunger valve to open in response to the pull of cables 26. It will be appreciated by those skilled in the art that valves having a pull type plunger can also be actuated by cable 26. The cable may be secured to the pull type plunger by any conventional means, directly or indirectly, such as by a clevis.

Referring now to FIG. 8, the guide 28 is threadably connected to a side plate 50 at a rear section of the side plate 50 and foot pedal 38. The wire cable 26 is shown entering from the guide 28 and by hashed line 52 interconnecting to a wire cable block 54. The wire cable block 54 is rotatably connected to a crank 56 via a cable pin 58. The crank 56 in turn is rotatably connected to a base plate 60 via a crank pin 62. The side plate 50 is attached to the base plate 60 by screws 64. A foot plate 66 is pivotally connected to the side plate 50 through a pin (not shown) in the position as shown by hashed lines 68. A corrugated resilient material 70 is fastened to the exposed top section of the foot plate 66. The corrugated resilient material 70 may be made of rubber or any other slip-resistant material for preventing slippage when the foot plate 66 is stepped on and actuated by the foot of an operator. A crank actuator block 72 is connected to the interior of the foot plate 66 by screws, for instance, in a position as shown by a hashed line 74. The crank actuator block 72 includes a camming section 76 and a latch spring 78. A release pedal 80 pivotally connects to the cable actuator block 72 together with a latch 82 through a latch pin 84. The interconnection of the release pedal 80, the crank actuator block 72, and the latch 82 by the latch pin 84 is shown in more detail in FIG. 7 add will be discussed in more detail later in the operation of the foot pedal portion of the present invention. The release pedal 80 also includes a corrugated resilient material 84. The release pedal 80 has its corrugated resilient material 84 and its supporting block exit into an opening 86 in the foot plate 66. A release pedal spring 88 holds the release pedal 80 above the corrugated material 70 of the foot plate 66 for release actuation as will be discussed later. The camming section 76 of the cable actuator block 72 interfaces with a camming pin 90 of the crank 56 to actually perform the movement of the wire cable 26 within the guide 28. A latch hook 92 is formed in the base plate 60 to interface with the latch 82.

The operation of the foot pedal 38 can best be described by referring to FIGS. 3–7. FIG. 3 shows the foot pedal 38 in the non-operational position. The same reference numerals are used for the same parts in all Figures to assist in the understanding of the interconnection and operation of the present invention. A cut away view of FIG. 3 shows the interconnection of the crank actuator block 72 interfacing with the crank pin 90 of the crank 56. The crank 56 is shown cut away to show the interaction of the camming section 76 of the crank actuator block 72 with the crank pin 90 and the interaction of the wire cable block 54 also with the crank 56 via the cable pin 58. The depression of the foot plate 66 and the interaction of the parts of the foot pedal 38 is shown in FIG. 4 while the operation of the push button valve 22 via the wire cable 26 can be shown by referring to FIG. 2.

Referring to FIG. 4, when the foot plate 66 is depressed and rotates about a plate pin 96, the camming section 76 of the cable actuator block 72 presses against the crank pin 90 and causes the crank 56 to rotate about the crank pin 62. The wire cable block 54 follows the movement through the cable pin 58 and thereby withdraws a portion of the wire cable 26 through the guide 28. In FIG. 2, pulling the wire cable 26 into the foot pedal 38, pulls the lever 42 downward through the lever spring 48 and the retainer 50. Pulling the lever 42 downward rotates the lever 42 about the lever pin 46 and causes the plunger 40 of the push button valve to be depressed into the valve 22. If the push button valve 22 is a normally closed valve, depressing the plunger 40 will open the valve and cause the water flow from the inlet water pipe 20 into the connecting water pipe 18 to exit out the faucet 14, see FIG. 1. The depression of the foot plate 66 thereby causes the water to exit the faucet 14. The foot plate 66 is held into the depressed position by a latching mechanism as is shown in FIG. 5.

Referring now to FIG. 5, when the foot plate 66 is depressed and the crank pin 90 and the crank 56 is rotated, the latch 82 is actuated forward by the latch spring 78 which is also fastened to the cable actuator block 72 (see FIG. 8). The latch 82 pivots forward about the latch pin 84 and connects to the latch hook 92 formed in the base plate 60 (see FIG. 8). The latch 82 and the latch hook 92 hold the foot plate 66 in its depressed position This is best shown by referring to FIG. 7.

In FIG. 7, the arms of the release pedal 80 (shown in cross-section in FIG. 7) and the latch 82 are shown pivotally connected to the cable actuator block 82 via hashed lines 94. The latch spring 78 urges the latch 82 in the forward position when the cable actuator block 72 is pressed downward together with the foot plate 66 (not shown). The camming section 76 operates against the crank pin 90 of the crank 56 to cause the wire cable 26 to be pulled into the foot pedal as was discussed in FIG. 4. Thus the latch 82 is urged by the latch spring 78 to contact the latch hook 92 as was discussed for FIG. 5.

Continuing with the discussion of FIG. 5, the latching of the latch 82 to the latch hook 92 holds the foot plate 66 in the depressed state. The release pedal spring 88, fastened to the underside of the foot plate 66 then urges the release pedal 80 upward to protrude from the opening 86 in the foot plate 66 (see FIG. 8). In this position, the water is flowing from the faucet 14 and the operator can wash himself in the standard manner as with any lavatory system. When the operator has completed his washing procedure, the operator can depress the release pedal 80 as is shown in FIG. 6.

Referring now to FIG. 6, the depression of the release pedal 80 causes the latch 82 to rotate out of position from the latch hook 92 against the latch spring 78.

This will release the foot plate 66. The lever spring 48 will cause the wire cable to be retracted in the guide 28, see FIG. 2. The retraction of the wire cable 26 will cause the crank 56 to rotate in the clockwise direction, see FIG. 4. The rotation of the crank 56 causes the foot plate to be released upward to its non-operational position as shown in FIG. 3. The mechanism thus returns to its non-operational position for actuation again by an operator when desired.

As shown in FIG. 1, a standard lavatory cabinet can be modified for foot operation control by the installation of the apparatus of the present invention. At least one push button valve 22 is installed into the inlet water pipe to control the flow of the water to the faucet 14. The lever 42 is pivotally connected to the push button valve 22 through support arm 44, see FIG. 2, to cause the actuation of the plunger 40 of the push button valve 22. The free end of the lever 42 is then connected to the wire cable 26 via the lever spring 48 and the retainer 50. The clamp 30 and the standard 32 hold the wire cable in position for the apparation of the push button valve 22 by fastening the standard 32 to the base 34 of the lavatory cabinet 10. The opening 35 is drilled in the base front 36 of the lavatory cabinet 10 for insertion of the wire cable 26 and the guide 38 into the interior of the lavatory cabinet 10. The foot pedal 38 is then positioned outside of the lavatory cabinet 10 adjacent to the base front 36. The foot plate 66 can then be depressed as shown in FIGS. 3 and 4 to actuate the push button valve 22 to cause the water to flow. The foot plate 66 will be latched in the actuating position as discussed in FIG. 5. The depression of the released pedal 80 will unlatch the foot plate 66 and the lever spring 48 will retract the wire cable 26 causing the lever 42 to be released and the plunger 40 to retract and thereby retract the plunger 40 from the push button valve to stop the water flow again.

The principles of the present invention have now been made clear in an illustrated embodiment. It will be immediately obvious to those skilled in the art many modifications of structure, arrangement, proportion, the element, materials, and components used in the practice of the invention. For instance, the push button valve 22 is shown normally closed and actuated open by the operation of the lever 42 pressing against the plunger 40 of the push button valve 22. It should be obvious that by changing the lever structure a normally open push button valve could be used and remain within the scope of the present invention. Likewise, the push button valve 22 is shown operating a single inlet water pipe. It should be obvious that the push button valve 22 could operate at the outlet of the mixing valve to control the hot and cold water combination. It is also within the scope of the instant invention that the release pedal may assume other structural equivalents such as a push button or slide for the purpose of engaging or disengaging for the latch 82. The appendant claims are, therefore, intended to cover and embrace any such modification, within the limits only of the true spirit and scope of the invention.

I claim:

1. A foot operated mechanism for use in combination with a valve means having a plunger for controlling flow through said valve means, said plunger being biased into a normally closed position, and for actuating said plunger into an open position for flow through said valve means, said foot operated mechanism comprising:

a base plate;

a crank pivotally connected to said base plate;

a foot plate pivotally connected to said base plate;

crank actuating means connected to said foot plate for pivoting said crank;

a latch pivotally mounted to said crank actuating means;

hook means formed in said base plate for catching said latch and operable therewith to hold said foot plate when pivoted;

release means engagable with said latch and actuable apart from said foot plate; and a cable communicating between said crank and said plunger;

whereby pivoting said foot plate pivots said crank and therefore pulls said cable to actuate said plunger and also engages said latch with said hook means;

said release means, when actuated, rotating said latch out of engagement with said hook means.

2. The foot operated mechanism as defined in claim 1, wherein said release means includes a release pedal positioned in an opening in said foot plate.

3. The foot operated mechanism of claim 2, wherein said release pedal is resiliently actuated to protrude above the surface of said foot plate when said foot plate is held by said latch and said hook means.

4. A foot operated mechanism for actuating a valve controlling a water supply to a faucet of a wash basin, said foot operated mechanism comprising a lever operable to control the opening and closing of the valve;

a cable having one end connected to said lever for moving the lever to activate the valve;

a base plate;

a crank connected to a second end of said cable and pivotally connected to said base plate for pulling said cable;

a foot plate pivotally connected to said base plate;

a crank actuating means connected to said foot plate for pivoting said crank;

a release pedal pivotally mounted to said crank actuating means, movable with said foot plate yet actuable apart from said foot plate;

a latch pivotally mounted to said crank actuating means together with said release pedal; and hook means formed in said base plate for catching said latch and operable therewith to hold said foot plate in a pivoted position;

whereby pivoting said foot plate pivots said crank and thereby pulls said cable to rotate said lever and also engages said latch to said hook means;

said release pedal, when pivoted, rotating said latch out of engagement with said hook means.

5. A mechanism for operating a push button valve for controlling the flow of fluid to a faucet mounted in a cabinet comprising:

a lever mechanism mounted to the valve and actuable to operate the push button of the valve;

a cable having one end connected to said lever mechanism through a lever spring and a retainer;

a foot pedal mechanism operable to pull said lever mechanism through said cable, said lever spring and retainer operable to return said cable when released by said foot pedal mechanism;

means to guide said cable between said lever mechanism and said foot pedal mechanism;

said foot pedal mechanism including:

a base plate;

a crank connected to a second end of said cable and pivotally connected to said base plate for pulling said cable;

a foot plate pivotally connected to said base plate;

crank actuating means connected to said foot plate for pivoting said crank;

a release pedal pivotally mounted to said crank actuating means and actuable apart from said foot plate;

a latch pivotally mounted to said crank actuating means with said release pedal; and hook means formed in said base plate for catching said latch and operable therewith to hold said foot plate when pivoted;

whereby pivoting said foot plate pivots said crank and therefore pulls said cable to operate said lever mechanism and also engages said latch to said hook means;

said release pedal, when pivoted, rotating said latch out of engagement with said hook means.

6. A mechanism for as defined in claim 5 wherein said release pedal is resiliently actuated and mounted in an opening in said foot plate such that said release pedal extends above said foot plate when said foot plate is pivoted to operate said latch mechanism.

7. A mechanism for controlling the flow of water from a water supply to a faucet mounted adjacent to a basin mounted in a cabinet, said mechanism comprising:

a push-button operative valve mounted between the water supply and the faucet;

a lever mechanism mounted to said valve and actuable to operate the push button of the valve to allow and prevent the flow of water from the water supply to the faucet;

a cable having one end connected to said lever mechanism through a lever spring and a retainer;

a foot pedal mechanism operable to pull said lever mechanism through said cable, said lever spring and retained operable to return said cable when released by said foot pedal mechanism;

said foot pedal mechanism including:

a base plate;

a crank connected to a second end of said cable and pivotally connected to said base plate for pulling said cable;

a foot plate pivotally connected to said base plate;

crank actuating means connected to said foot plate for pivoting said crank;

a release pedal pivotally mounted to said crank actuating means and actuable apart from said foot plate;

a latch pivotally mounted to said crank actuating means with said release pedal; and hook means formed in said base plate for catching said latch and operable therewith to hold said foot plate when pivoted;

whereby pivoting said foot plate pivots said crank and therefore pulls said cable to operate said lever mechanism and releasing said foot plate allows said lever spring and retainer to retract said cable thereby releasing said lever mechanism; and whereby pivoting said releases pedal rotates said latch out of engagement with said hook means and thereby releases said foot plate.

8. A mechanism as defined in claim 7 wherein said release pedal is resiliently actuated and mounted in an opening in said foot plate such that said release pedal extends above said foot plate when said foot plate is pivoted to operate said latch mechanism.

* * * * *

UNITED STATES PATENT AND TRADEMARK OFFICE

CERTIFICATE OF CORRECTION

PATENT NO. : 5,199,119

DATED : 6 April 1993

INVENTOR(S) : Ronald D. Weber

It is certified that error appears in the above-identified patent and that said Letters Patent is hereby corrected as shown below:

In claim 7, column 7, line 29, delete "operative" and insert --operated--.

Signed and Sealed this

Thirtieth Day of November, 1993

Bruce Lehman

*Attest:*

BRUCE LEHMAN

*Commissioner of Patents and Trademarks*

*Attesting Officer*